United States Patent [19]

Kunkle

[11] 4,061,406

[45] Dec. 6, 1977

[54] HIGH CURRENT CARRYING CONNECTOR

[75] Inventor: John Philip Kunkle, Harrisburg, Pa.

[73] Assignee: AMP Incorporated, Harrisburg, Pa.

[21] Appl. No.: 501,374

[22] Filed: Aug. 28, 1974

[51] Int. Cl.[2] ..... H01R 13/28

[52] U.S. Cl. ..... 339/47 C

[58] Field of Search ..... 339/47–49

[56] References Cited

U.S. PATENT DOCUMENTS

| | | | |
|---|---|---|---|
| 3,083,345 | 3/1963 | Scheller | 339/47 R |
| 3,634,811 | 1/1972 | Teagno et al. | 339/47 R |
| 3,676,833 | 7/1972 | Johnson | 339/49 R |

FOREIGN PATENT DOCUMENTS

| | | | |
|---|---|---|---|
| 2,060,426 | 6/1971 | Germany | 339/47 R |

*Primary Examiner*—Joseph H. McGlynn
*Attorney, Agent, or Firm*—Donald W. Phillion

[57] ABSTRACT

A first half of a two piece connector housing has a plurality of parallel tubular elements extending from a common backing and defining a plurality of first cavities, each containing a hermaphroditic contact. The second half of the housing has a grid-like network of partitioning walls which define a plurality of second cavities and which fit in-between the tubular members of the first half. Each second cavity also contains one of said hermaphroditic contacts which mates with an aligned hermaphroditic contact in a cavity in the first housing half. Each contact has a trough-like element and a pair of leaf-like spring elements mounted thereon. Two such contacts will mate when inverted with respect to each other, with the leaf-like elements of one contact mating with the inner surfaces of the trough-like elements of the other contact to provide four separate areas of electrical conduction.

3 Claims, 9 Drawing Figures

HIGH CURRENT CARRYING CONNECTOR

BACKGROUND OF THE INVENTION

This invention relates generally to high current carrying connectors, and more particularly to connectors having a multiplicity of circuit connections therein, each capable of conducting a high current and each comprising a pair of hermaphroditic contacts.

There are today many uses for high current carrying connectors, both in the home and in industry. For example, in the home, electric dryers, air conditioners, ranges, and electric heating require individual heavy duty connectors which usually consist of a Bakelite material female receptacle mounted on the wall and a mating three prong plug connected to the appliance. These heavy duty connectors are relatively expensive and ordinarily each of them services only one appliance.

The need for heavy duty connectors is much greater in industrial applications which also include such things as air conditioning, heating and lighting, and in addition include hundreds of thousands of heavy duty motors, magnetic driven devices, electroplating equipment, machine tools in general, etc.

Also in industrial applications a piece of equipment frequently requires large currents to perform more than one function. For example, a given piece of equipment may contain several high current consuming motors. To supply power for such industrial applications, cables are often connected directly from a circuit breaker box to a lug or screw type terminal located on or within the piece of equipment to be powered. From the array of lugs or screw-down type terminal board, a plurality of cables or conductors are connected to the various power consuming devices in the equipment.

Whether one motor or several are connected to a lug-type or screw-type terminal board, it is usually necessary to remove protective panels and to then disconnect the cables from the terminal board in the event of motor failure, or when an exchange of motors is needed. Also, in the case where several motors or other power consuming devices are connected to a common terminal board, the possibility of making incorrect connections is ever present.

BRIEF STATEMENT OF THE INVENTION

It is a primary object of the invention to provide a multiple circuit connector in which each circuit has a high current carrying capability and which can be used in lieu of the present, conventional lug or screw-down type terminal boards.

A second object of the invention is an expensive, multiple circuit, two-part connector in which each circuit has a high current carrying capability.

A third aim of the invention is an inexpensive, multiple circuit connector, in which each circuit employs a pair of mating hermaphroditic contacts of high current carrying capacity.

A fourth purpose of the invention is an inexpensive, two part connector having a plurality of high current carrying connections, each of which connections employs a pair of mating hermaphroditic contacts.

A fifth aim of the invention is the improvement of high current, multiple circuit connectors generally.

In accordance with one embodiment of the invention, there is provided a pair of mating housing elements, with a first of said housing elements comprising a grid-like network of walls which form a plurality of cavities, each cavity being substantially rectangular in cross-sectional configuration, and all of which have axes which are substantially parallel with each other. The second housing element comprises a series of cavity defining tubes of generally rectangular configuration and each of which fits into one of the cavities of the first housing half.

Each of the cavities in the first housing half and in the second housing element are constructed to retain one of the hermaphroditic contacts. When the two housing elements are mated together, the hermaphroditic contacts retained therein are aligned in such a manner that they also mate with each other to form a plurality of completed circuits, one circuit being formed by each pair of mated hermaphroditic contacts.

Because of the grid-like arrangement of the first of said housing elements and the tubular type construction of the second housing element, each pair of mated contacts is separated from the adjacent pairs of mated contacts by three walls of insulative material.

Each of said hermaphroditic contacts comprises at one end thereof a channel-like section, and a pair of spaced apart, elongated contact elements mounted above the open side of said channel-like section with the axes of the pair of contact elements and the channel-like section being substantially parallel with each other. The other end of each of said contacts comprises a means, such as a crimping means, for making contact with an incoming conductor and also a strain relief means.

The spaced apart elongated contact elements of each of said hermaphroditic contacts fit within the channel-like portion of the mating hermaphroditic contact. Thus, a pair of such hermaphroditic contacts mate with each other, when one is inverted with respect to the other, so that the pair of spaced apart, elongated contact elements of each of the two contacts mates with the channel-like portion of the other contact, thereby making four separate contact areas.

Because of these four separate contact areas and the size of each area, and further because of the flow of cooling air permitted around the contact configuration and through the space in between the spaced apart contacts, the current carrying capacity between two such mated contacts is very high.

In accordance with a feature of the invention each of the spaced apart contact elements has an elongated embossment thereon which makes contact with the adjacent inner wall of the channel-like section of the mating contact. Since only the embossments make contact with the channel-like section of the mating contact, the force per-unit-area of contact between the embossments and the mating channel is very high and provides an excellent and reliable electrical connection. Furthermore, the use of such embossments enables cooling air to flow in between the spaced apart contacts and the adjacent wall of the mating channel-like section.

BRIEF DESCRIPTION OF THE DRAWINGS

The above-mentioned and other objects and features of the invention will be more fully understood from the following detailed description thereof when read in conjunction with the drawings in which.

DETAILED DESCRIPTION OF THE INVENTION

Figures 1, 2, 3:
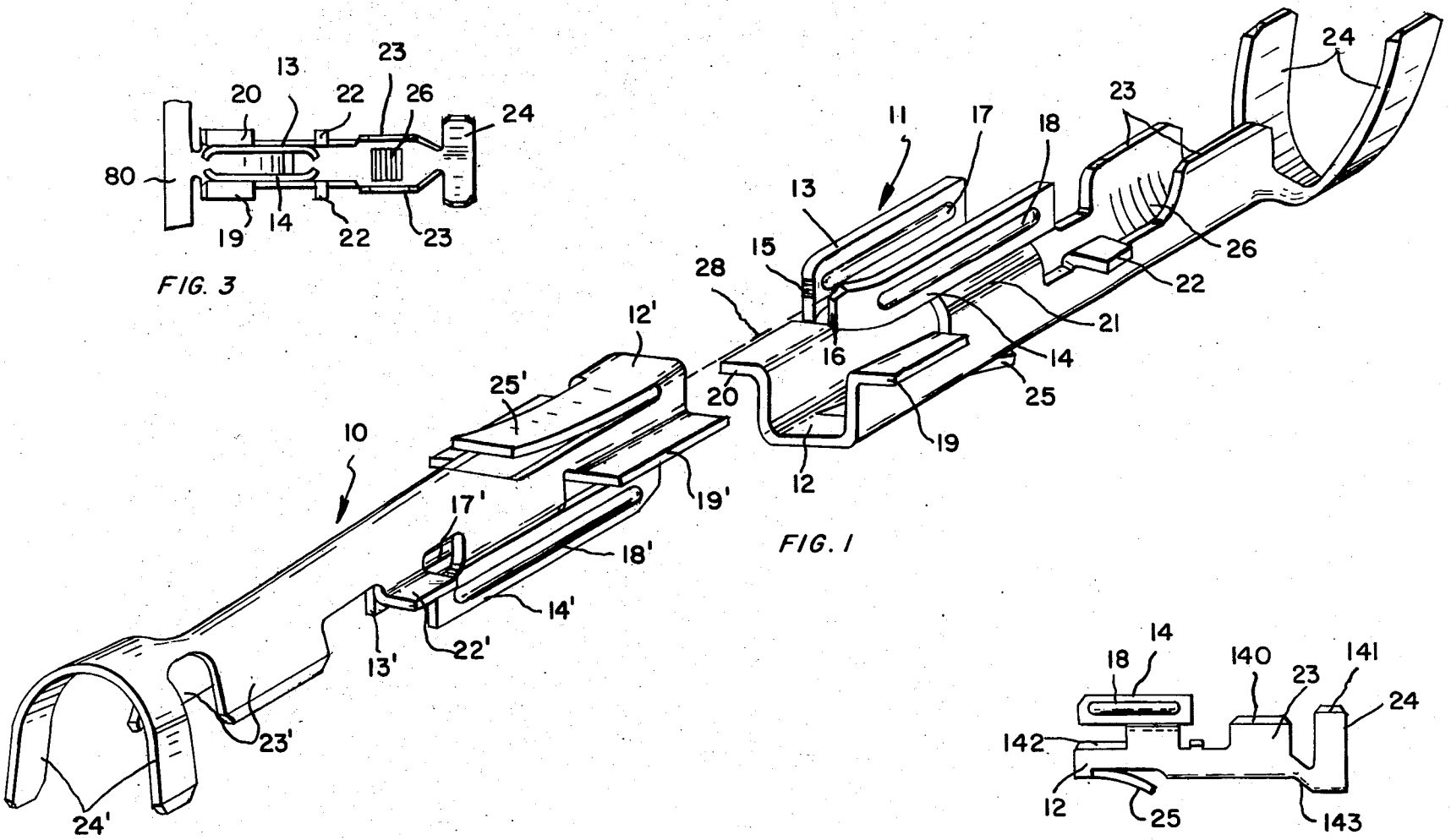
FIG. 1 shows a perspective view of a pair of hermaphroditic contacts in a position to mate with one another if they are advanced towards one another along their longitudinal axes.
FIG. 2 is a side view of one of the contacts of FIG. 1.
FIG. 3 is a top view of one of the contacts of FIG. 1.

Referring now to FIG. 1 there is shown a pair of hermaphroditic contacts 10 and 11 positioned so that they will mate when they are pushed together along the dotted line 28. The two contacts 10 and 11 shown in FIG. 1 are identical in every respect except that one of them is inverted 180° with respect to the other. Accordingly, only one of the contacts, namely contact 11, will be described in detail.

Figure 5:
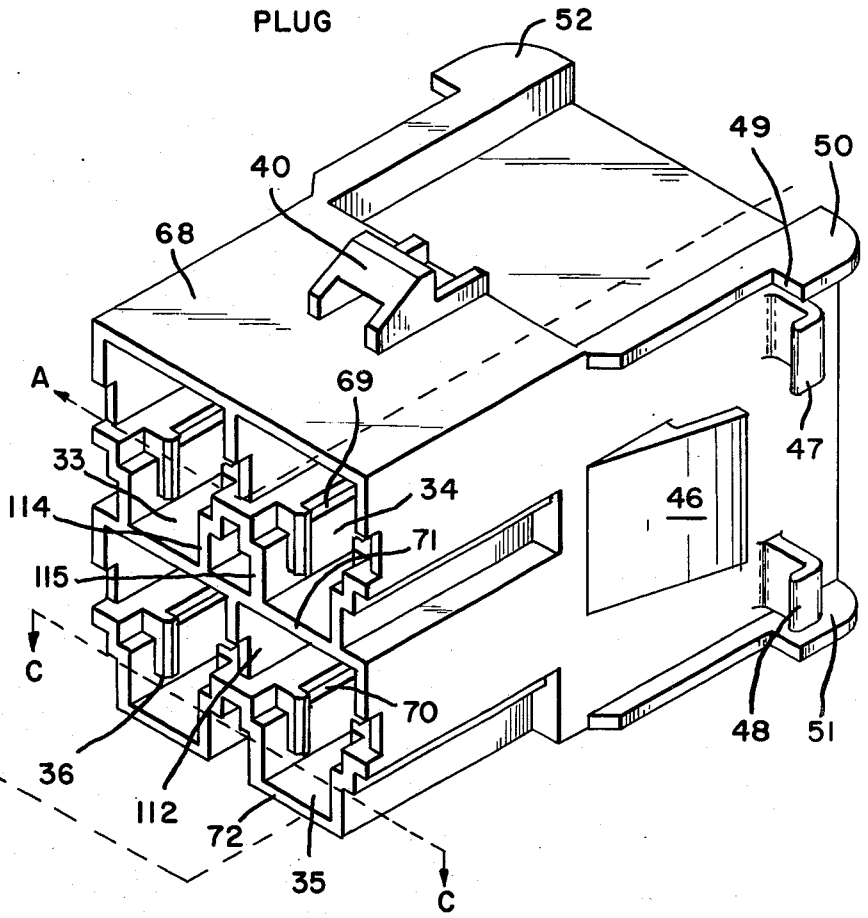
FIGS. 4 and 5 show the cap half and the plug half, respectively, of the two halves of the two-part housing which holds the hermaphroditic contacts shown in FIG. 1.
Figure 4:
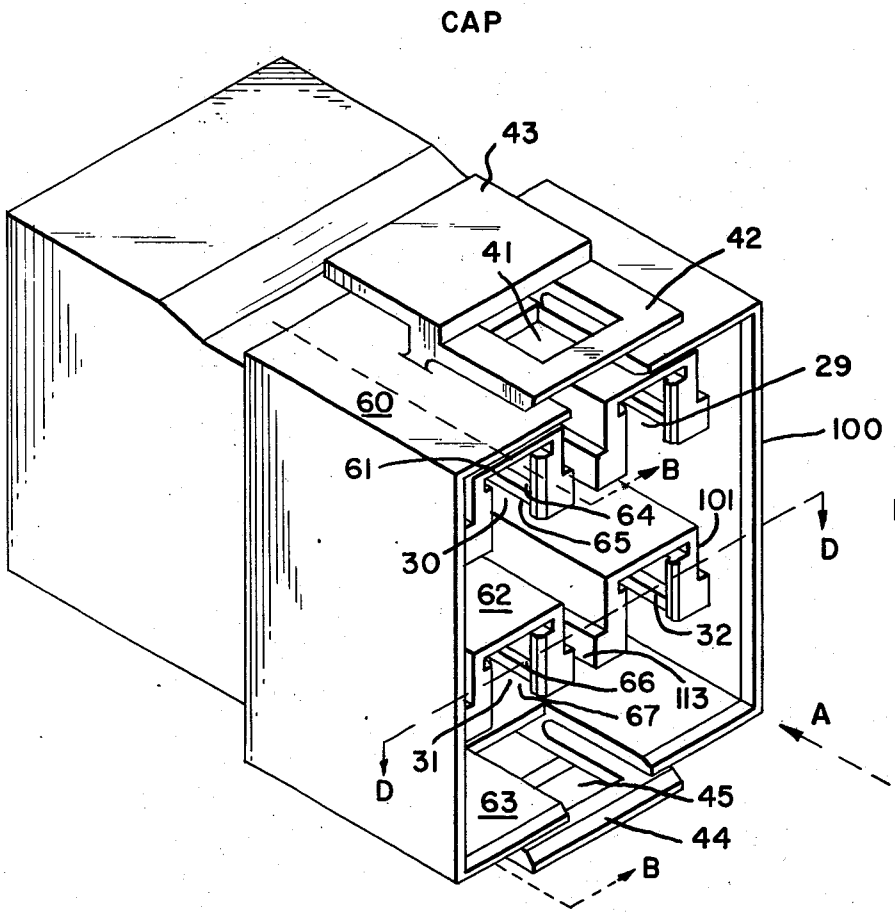

It is to be understood that contacts exactly like contacts 10 and 11 are retained within the various cavities in the two housing halves shown in FIGS. 4 and 5. Without discussing FIGS. 4 and 5 in detail at this time, it should be noted that the cap structure of FIG. 4 contains four cavities designated generally by reference characters 29, 30, 32 and 41, which mate respectively with the cavities 33, 34, 35 and 36 in the plug housing half shown in FIG. 5.

In each of these eight cavities 29 - 36, a contact as shown in FIG. 1 is retained. In the housing half shown in FIG. 4, herein defined as the cap portion of the housing, contacts in the position represented by contact 10 of FIG. 1 are retained in the cavities 29 through 31. In the housing half shown in FIG. 5 herein known as the plug portion of the housing, each of the four cavities 33 through 36 retain one of the contacts in the position shown by contact 11 in FIG. 1. Thus, the housing of FIG. 4 contains four contacts in each of the cavities 29 through 32 which are in inverted positions with respect to the four contacts contained in the cavities 33 through 36 of the housing half of FIG. 5. When the two housings are mated together, the contacts retained in mating cavities are aligned in such a manner that they also mate in the manner shown in FIG. 1.

Returning again to a detailed discussion of FIG. 1, the contact 11 contains a U-shaped channel portion 12. Mounted upon this channel portion 12, by means of mounting elements, such as mounting element 21, are the two elongated, spaced-apart contacts 13 and 14, with the longitudinal axes of the spaced-apart contacts 13 and 14 and the channel portion 12 all being substantially parallel.

On each of the spaced-apart contacts 13 and 14 there is an embossed portion, such as embossed portions 17 and 18. The convex side of these embossed portions is on the outside surfaces of the two contacts 13 and 14.

Referring now to FIGS. 2 and 3 there is shown respectively a side view and a top view of the contact 11 of FIG. 1. Corresponding elements are identified by the same reference characters. In addition, certain beveled edges are shown in FIG. 2. Specifically, the wire holding barrel 23 and the strain relief barrel 24 have beveled edges 140 and 141 and the trough has a beveled edge 142. A neck portion 143 is shown joining the strain relief barrel 24 to the wire barrel 23.

In FIG. 3 the contact is shown connected to a carrier strip 80 which is present during the manufacture of the contacts but which is removed before the contacts are installed in their housings.

As can be seen from FIG. 1, the two spaced-apart elongated contacts 13 and 14 fit inside the channel portion 12′ of the inverted contact 10, with the embossed sections 17 and 18 making firm physical contact with the inner side of the channel 12′ of contact 10.

In a similar manner, the elongated contact elements 13′ and 14′ of contact 10 slide inside channel 12 of contact 11, with the raised embossed surfaces 17′ and 18′ making physical contact with the inner surfaces of the sidewall of the channel portion 12 of the contact 11.

Thus, there are four distinct areas of contact made between the two contacts 10 and 11 when they are pushed together along the direction of the line 28. These four contact areas are between the embossed areas 17 and 18 of contact 11 and the sidewalls of channel 12′ of contact 10, and between the embossed areas 17′ and 18′ of contact 10 and the inner walls of the channel section 12 of contact 11.

Figure 6:
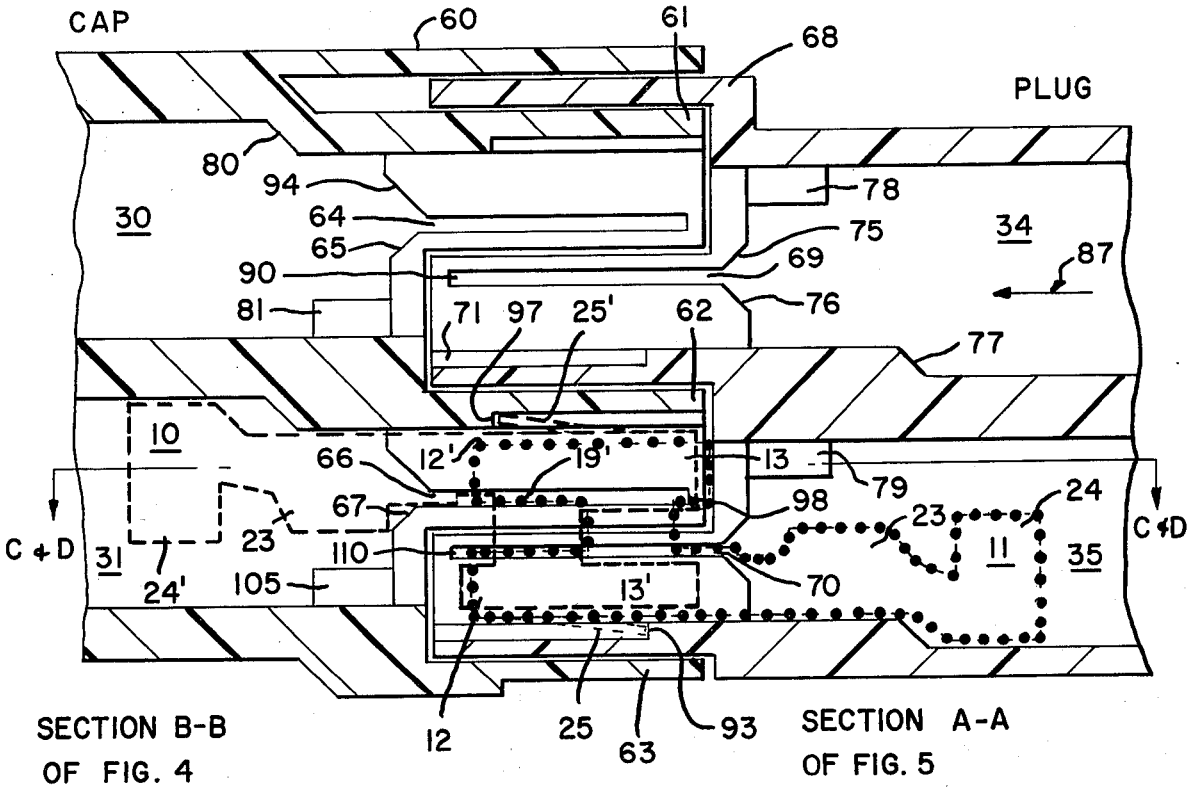
FIG. 6 shows a cross-sectional view of the half housing sections (cap and plug) of FIGS. 4 and 5 along the sectional planes A—A and B—B of FIGS. 4 and 5 when they are in a mated condition.

Without making a detailed discussion thereof at this time, reference is made to FIG. 6 which shows the relative positions of two contacts, such as contacts 10 and 11, when they are in the mated condition.

Returning again to FIG. 1, the ends 15 and 16 of the spaced-apart leaf contacts 13 and 14 are turned inwardly towards each other, as well as being bevelled along their height so as to facilitate entry into the channel 12′ of the inverted contact 10.

At the rear end of contact 11, that is the right hand end of contact 11 in FIG. 1, there is provided two sets of crimpable barrels 23 and 24. The barrel 23 has a serrated portion 26 and functions to crimp the bare wire conductor inserted therein. The barrel 24 is not crimped and functions as a strain relief means which is crimped around the insulated portion of a wire laid therein.

Three horizontal tabs 19, 20 and 22 are shown formed on contact 11. A fourth tab, similar to tab 22 but on the other side of the contact 11 and not visible in FIG. 1, is also provided. These four tabs fit into guiding slots in the housing structure of FIG. 5 and fix the position of contact 11 in such housing in all three coordinates (X, Y and Z). Similar tabs 19′ and 22′ and two other tabs on the other side of contact 10 (not visible in FIG. 1) fit into similar slots or grooves in the housing of FIG. 4 and fix the position of the contact 10 therein in the X, Y and Z coordinates. Thus, when the housing halves of FIGS. 4 and 5 are mated, the contacts therein, such as contacts 10 and 11, will also mate properly.

When in a mated condition, the construction of the contacts, such as contact 11, permit air flow in between the leaf springs 13 and 14 and also between the outer walls of leaf springs 13 and 14 and the inner walls of the mating channel, such as channel 12′, because of the raised embossed areas 17 and 18 on the outer surfaces of leaf springs 13 and 14. Such enabling free air flow in and around the contact area provides for a very considerable cooling effect on the contacts, and prevents a temperature rise therein when large currents are caused to pass therethrough.

It should be noted also that a low temperature rise in the mated contacts 10 and 11 is due to the excellent electrical contact between the four embossed areas of leaf springs 13, 14, 13' and 14' with their respective mating channel areas 12' and 12 of the opposite, mating contacts.

In summary, it is a combination of the number of contact areas, the quality of the contact made in these contact areas, and the freedom of air flow in and around the contacts which enables the large current flow therethrough.

As will be seen later, insulation between pairs of mated contacts, provided by the housing structures of FIGS. 4 and 5, ensures against electrical breakdown between the various pairs of mated contacts without materially impeding the cooling effect caused by the freedom of air flow in and around the contact areas, as discussed above.

Before the contacts are inserted in the housing halves, such as shown in FIGS. 4 and 5, conductors are first crimped in barrels 23 and 24 and 23' and 24' to make good electrical contact and to retain the wire therein. The contacts, such as contacts 10 and 11, are then inserted through the rear of each of the housing structures of FIGS. 4 and 5. The rear of such housing structures is defined is that surface which cannot be seen in FIGS. 4 and 5. More specifically, the surfaces exposing the cavities 29 – 36 in the housing of FIGS. 4 and 5 are defined as the front surfaces of the two housing halves. The mating portions of the contacts, such as the pair of leaf springs 13 and 14 and the channel 12 of contact 11, are exposed at the cavity openings 29 – 36 shown in FIGS. 4 and 5.

Before discussing the inner construction of the housing halves of FIGS. 4 and 5, respectively, some of the external features of such housing will be discussed. On the plug of FIG. 5 there is provided a pawl 40 which fits into detent 41 of locking mechanism 42 in the housing half of FIG. 4 after the two housing halves have been mated together to prevent unauthorized separation thereof.

On the sidewall of the housing half of FIG. 5 there is provided a means for mounting such housing half on a panel. Such means includes an element 46, two resilient ear-like means 47 and 48 and a pair of tabs 50 and 51 each of which has shoulders thereon, such as shoulder 49 of tab 50. A similar pair of tabs is located on the other side of the housing structure of FIG. 5. One of these tabs is designated by reference character 52 and the other cannot be seen in FIG. 5.

To mount the housing half of FIG. 5 on a panel, the housing is inserted into a rectangular aperture in such panel (not shown) from right to left in FIG. 5. More specifically, the surface shown in the open cavities in FIG. 5 is inserted first. The panel passes over the tab 46 which snap inwardly towards the housing when said panel is passing thereover. After the panel has passed completely thereover, the tab 46 will spring outwardly, thereby preventing removal of the housing therefrom. The two spring-like elements 47 and 48 are formed so that they are bent backwards, i.e., to the right in FIG. 5 when the housing is installed in the panel, thereby maintaining a constant pressure against said panel. The shoulders, such as shoulder 49 on tab 50, prevents the housing from being inserted too far into a panel and breaking off or damaging the tabs 47 and 48.

Referring now to FIG. 6 there is shown a cross-sectional view of the two housings of FIGS. 4 and 5 in a mated condition and taken along the plane A—A of the plug of FIG. 5 and along the plane B—B of the cap of FIG. 4.

The sectional views along both planes A—A and B—B cut vertically through the center of a pair of cavities, with those walls that are severed by the planes A—A and B—B being shown as cross-hatched areas and the vertical walls of the cavities being shown without hatched lines.

Further, a pair of mated contacts is shown in a pair of mating cavities in the two housing halves in FIG. 6. Similar elements in FIGS. 4, 5 and 6 are represented by similar reference characters.

Considering first the plug portion of FIG. 6, which corresponds to the structure of FIG. 5, there are shown two cavities 34 and 35 each of which contains a contact, such as the contact 11, which is inserted in the cavity 34 in the direction of the arrow 87. A contact in dotted line form is shown in cavity 86 only. It is to be understood, however, that a similar contact is retainable in the cavity 34. For purposes of clarity of discussion, the cavity 34, without a contact, will be discussed first.

As a contact is inserted into the cavity 34 in the direction of arrow 87, it is guided into the proper location by the ramp areas 77, 75, 76 and 78. The ramp area 77 is a relatively large surface and functions as a coarse guide for the contact as it enters into the cavity 34. The two ramp areas 75 and 76 are smaller ramped areas and function to guide the tabs 19, 20 and 22 of contact 11 of FIG. 1 into the slot 69 of cavity 34. A slot similar to slot 69 exists on both sides of cavity 34 to receive the tabs, such as tabs 19, 20 and 22, existing on both sides of the contact 11 of FIG. 1.

In the view of FIG. 6, the tab 20 fits into the slot 69 and can be moved therein to the end 90 of said slot 69. Thus, the contact 11 of FIG. 1 is positioned within cavity 34 in the three coordinates, X, Y and Z.

Referring now to the lower cavity 35, a contact 11 is shown inserted therein. The major parts of the contact are identified by the same reference characters which identify corresponding parts of contact 11 in FIG. 1. Thus, in FIG. 6, starting at the right of contact 11, there is shown the insulating barrel 24, the wire barrel 23, the leaf spring-type contact 13, the channel contact area 12, and the tang 25. It is to be noted that the tang 25 slides into the plug housing and when fully inserted, will drop behind the shoulder 93 of said plug housing to prevent unauthorized withdrawal of contact 11 from cavity 35.

Consider next the cap portion of the housing. There is an outside wall 60 which fits over the outside wall 68 of the plug portion of the housing. As in the case of the plug portion of the housing, two cavity sections 30 and 31 are shown in FIG. 6. The cavity 31 contains an inverted contact element 10 shown in dotted line form. Again, for purposes of clarity, the cavity 30, which is shown as not containing a contact, will be discussed first. The ramp 80 provides a vertical guide for a contact as it is inserted in the cavity 30. A second ramp 81 provides a horizontal guide for the contact as it is inserted in cavity 30, an is shown more clearly in FIG. 7, which will be discussed later herein. The two shoulders 94 and 65 provide a guide for the contact tabs into the slot 64. The contact tabs referred to are identified by reference characters 19' and 22' in FIG. 1.

Referring now to the lower cavity 31, it can be seen that the inserted contact 10 has its trough portion 12' mated with the leaf spring portion 13 of contact 11 which is contained in the plug portion of the housing. Also, the leaf spring portion 13' of contact 10 in the cap half of the housing mates with the trough portion 12 of contact 11 on the plug portion of the housing. Other elements of contact 10 are identified by the same reference characters as are corresponding portions of contact 10 of FIG. 1.

Similar to the action of contact 11, the contact 10 is inserted into cavity 31 until the tab portion 19' thereof reaches the end 98 of slot 66 in said cavity 31. The tang portion 25' on contact 10 snaps into place behind the shoulder 97 in the housing wall 62 of cavity 31. Thus, the contact 10 is locked into cavity 31 in all three coordinates, X, Y and Z.

Figure 7:
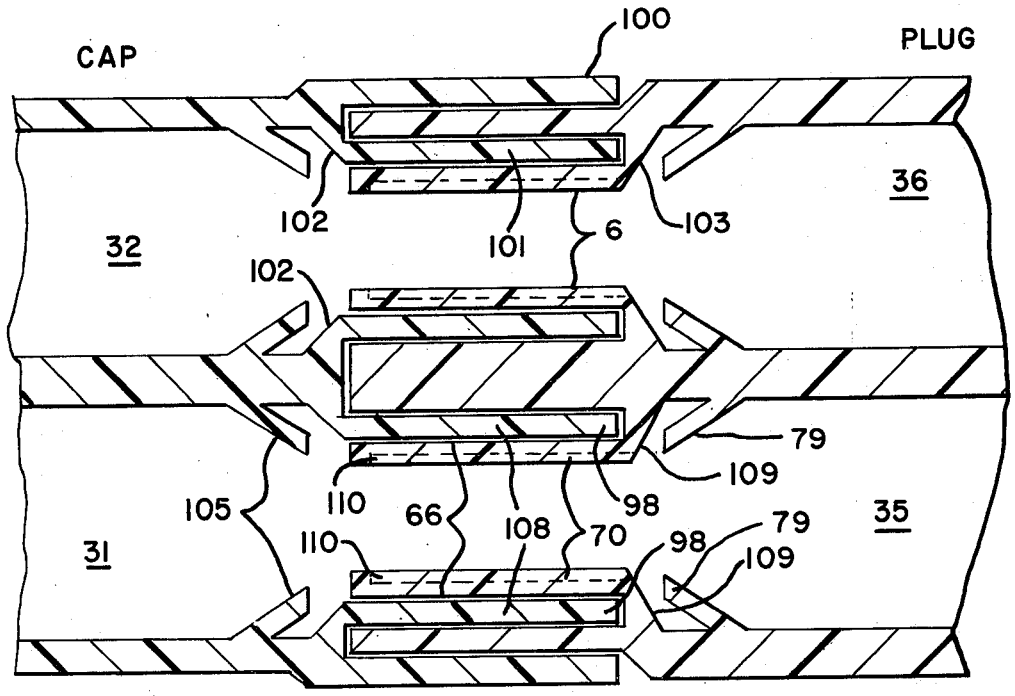
FIG. 7 is a top sectional view of the mated housing halves of FIGS. 4 and 5 taken along the sectional planes D—D and C—C of the cap and plug respectively.

Referring now to FIG. 7 there is shown a sectional view of the cap and the plug of FIGS. 4 and 5 taken along the planes D—D and C—C respectively. In FIG. 7, as in the case of FIG. 6, parts of the housing which correspond to parts shown in FIGS. 4, 5 and 6 are identified by the same reference characters in FIG. 7.

In FIG. 7, cavities 31 and 32 are shown in the cap portion of the housing correspond to slots 31, 32 of FIG. 4. In the plug portion of the housing cavities 36 and 35 are shown in FIG. 7 which correspond to cavities 36 and 35 in the plug portion shown in FIG. 5. The tangs 105 in the cap portion form ramp surfaces which guide the contact (not shown) into the cavity 31. The slots 66 of the housing wall 108 hold the tabs, such as tabs 19, 20 and 22 of the contact 11 of FIG. 1, which extend to the end 98 of the slot 66.

In the plug portion of the housing in FIG. 7 two cavities 36 and 35 are shown. The tangs 79 also form ramp surfaces for guiding the contact into the plug portion of the housing. Once past the tang 79, the contact encounters further ramps 109 which provide further guidance of the contact. The tabs of the contact, such as tabs 19' and 22° of contact 10 of FIG. 1, then slide into the slots 70 in the housing plug and proceed to the end 110 of such slot 70.

Referring again generally to the structure of FIGS. 4 and 5, the outside walls of the plug of FIG. 5 fit within the outer walls of the cap of FIG. 4, and the individual cavity sections 29 through 32 of FIG. 4 generally fit within the cavity sections 33 through 36 of the plug of FIG. 5. For example, the wall 112 of the plug of FIG. 5 fits within the gap between the two cavities 31 and 32 of the cap of FIG. 4, so that between the contacts located within the cavities 31 and 32 there are three separate walls of insulative material, two of such walls being the adjacent walls of the two cavities 31 and 32 and the third wall being the wall 112 of the plug of FIG. 5 which fits in between the two cavities 31 and 32 of FIG. 4.

The two walls 114 and 115 of the plug of FIG. 5 form a double wall thickness of course, between the lower portions of the two contacts contained in cavities 34 and 33, and when such contacts are mated with the contacts contained in cavities 30 and 29 of FIG. 4, the walls 114 and 115 will also provide a double wall thickness of insulation between the two contacts contained in cavities 29 and 30 of FIG. 4.

Figure 9:
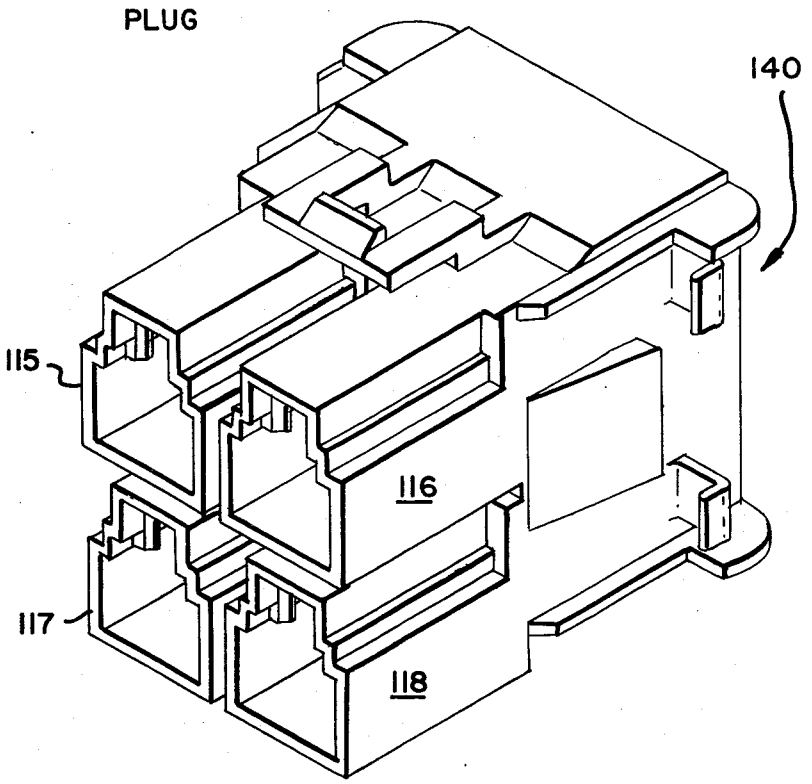
Figure 8:
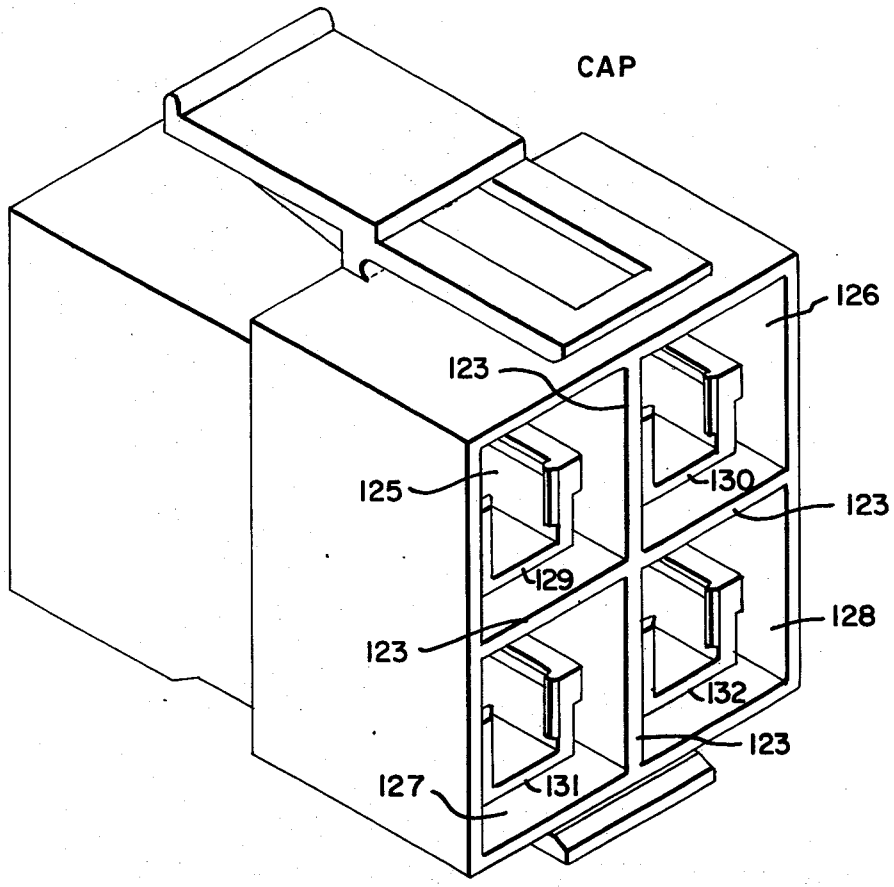
FIG. 8 is a skeleton view of a form of the invention wherein one half of the housing consists of a series of tubes of rectangular cross-section, with each tube containing a contact, and in which the other half of the housing has a grid-like network of walls which form cavities, each containing another mating contact, and with each tubular section of the first housing fitting within one of the cavities formed by the grid-like network of walls in the second housing half.

Referring now to FIGS. 8 and 9 there is shown a housing arrangement whereby the plug portion of the housing consists of a plurality of rectangularly-shaped tubes, such as tubes 115, 116, 117 and 118, with each tube constructed to receive and retain a contact. The cap portion of the housing has a rectangularly-shaped grid-like network of walls 123 which form receiving cavities 125 through 128 for each of the cavity defining tubular elements 115 through 118.

Within each of the receiving cavities 125 – 128 is a contact retaining cavity means 129 – 132 each of which is similar to the cavities 29, 30, 31 and 32 of the cap of FIG. 4.

Each of the said tubular elements 115 through 118 is mounted upon a common base denoted generally as 140, and which is similar in construction to the corresponding rear portion of the plug of FIG. 5.

It is to be understood that the forms of the invention shown and described herein are but preferred embodiments thereof and that various changes can be made in the details of the contact design as well as in details of the two portions of the housing without departing from the spirit or scope of the invention.

I claim:

1. A connector comprising:

a first housing portion comprising a first common base and a first network of partitions supported on said common base which define a plurality of first cavities thereon with each first cavity having at least one adjacent cavity;

those partitions defining each first cavity being separated from those partitions defining adjacent cavities by a spacing therebetween;

a second housing portion matable with said first housing portion and comprising a second common base and a newtork of second partitions which are supported on said second common base and which define a plurality of second cavities with each cavity having at least one adjacent cavity;

the said network of second partitions forming a grid-like pattern which fits into the spacings between the partitions forming each of said first cavities to mate each of said first cavities with an individual one of said second cavities;

a hermaphroditic contact retained in each of said cavities of said first and second housing portions;

said first and second housing portions constructed to retain one of said hermaphroditic contacts in each matable pair of cavities in a position to become mated with each other when said first and second housing portions are mated;

each of said matable contacts comprising:

a trough-like element at one end of said contact;

a pair of elongated, leaf-like elements mounted upon said trough-like element;

and means for retaining a conductor of another end of said contact;

said pair of elongated, leaf-like elements of each contact of each pair of matable contacts being constructed to fit within the trough-like element of the other contact of said matable pair of contacts to provide four separate areas of electrical contact between the four leaf-like elements and the two trough-like elements of a mating pair of said matable contacts;

each of said matable contacts further comprises an embossed area on each of said elongated leaf-like elements;

said embossed areas being positioned on said leaf-like elements to make contact with the inner surface of the trough-like element of the contact which mates therewith to enable cooling air to flow between said inner surfaces and said trough-like element and the mating leaf-like elements adjacent thereto.

2. A connector comprising:

a first housing portion comprising a plurality of first cavities therein;

a second housing portion matable with said first housing portion and comprising a plurality of second cavities therein each matable with one of said first cavities; and a hermaphroditic contact retained in each of said cavities of said first and second housing portions;

said hermaphroditic contacts constructed to be matable with each other in pairs;

said first and second housing portions each constructed to retain a pair of said matable contacts in each matable pair of cavities in positions enabling each pair of said matable pairs of contacts to become mated when said first and second housing portions are mated;

each of said matable contacts comprising:

a trough-like element;

a pair of elongated, leaf-like elements mounted over said trough-like element;

and means for retaining a conductor on said contact;

said pair of elongated, leaf-like elements and each contact of each pair of matable contacts being constructed to fit within the trough-like element of the other contact of said matable pair of contacts to provide four separate areas of electrical contact between the four leaf-like elements and the two trough-like elements of a mating pair of said matable contacts;

each of said matable contacts further comrising an embossed area on each of said elongated leaf-like elements;

said embossed areas being positioned on said leaf-like elements to make contact with the inner surfaces of the trough-like element of the mating contact to enable cooling air to flow between said inner surfaces and said trough-like element and the mating leaf-like elements adjacent thereto.

3. In a connector for retaining at least one pair of hermaphroditic contacts and comprising a first housing portion comprising at least one first cavity therein and a second housing portion matable with said first housing portion and comprising at least one second cavity therein matable with said first cavity, and with said first and second housing portions constructed to retain one of said hermaphroditic contacts in each matable cavity in positions enabling said at least one pair of hermaphroditic contacts to become mated when said first and second housing portions are mated, each of said matable contacts comprising:

a trough-like element;

a pair of elongated spring elements mounted upon said trough-like element;

and means for retaining a conductor;

said pair of elongated spring elements of a pair of mated contacts being constructed to fit within the trough-like element of the other contact of said pair of mated contacts to provide four separate areas of electrical contact between the four spring elements and the two trough-like elements of a pair of mated contacts;

each of said matable contacts further comprises a raised area on each of said elongated spring elements;

said raised areas being positioned in said spring elements to make contact with the inner surfaces of the trough-like element of the mating contact to enable cooling air to flow between said inner surfaces of said trough-like element and the mating spring element adjacent thereto.

* * * * *